US011371392B1

(12) United States Patent
Walsh et al.

(10) Patent No.: US 11,371,392 B1
(45) Date of Patent: Jun. 28, 2022

(54) SYSTEM AND METHOD FOR IMPROVING STARTUP TIME IN A FOSSIL-FUELED POWER GENERATION SYSTEM

(71) Applicant: GENERAL ELECTRIC COMPANY, Schenectady, NY (US)

(72) Inventors: Bernard Walsh, Montague, MA (US); Ronald Nowak, Longmeadow, MA (US); Bryan Mruk, Agawam, MA (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 25 days.

(21) Appl. No.: 17/143,325

(22) Filed: Jan. 7, 2021

(51) Int. Cl.
*F01K 13/02* (2006.01)
*F01K 7/16* (2006.01)
(Continued)

(52) U.S. Cl.
CPC ..... *F01K 13/02* (2013.01); *F01K 3/24* (2013.01); *F01K 7/16* (2013.01); *F01K 7/24* (2013.01); *F01K 13/00* (2013.01); *F01K 3/186* (2013.01); *F05D 2210/12* (2013.01); *F05D 2220/31* (2013.01); *F05D 2260/20* (2013.01); *F22B 33/185* (2013.01); *F22B 35/04* (2013.01)

(58) Field of Classification Search
CPC . F01K 3/24; F01K 3/242; F01K 3/245; F01K 3/247; F01K 13/00; F01K 13/006; F01K 13/02; F01K 7/16; F01K 7/165; F01K 7/18; F01K 7/20; F01K 7/22; F01K 7/24; F01K 7/26; F01K 7/28; F01K 7/223; F01K 7/226; F01K 1/04; F01K 1/08; F01K 3/008; F01K 3/02; F01K 3/04; F01K 3/14; F01K 3/16; F01K 3/186; F22B 35/008; F22B 35/02; F22B 35/04; F22B 35/06; F22B 35/08; F22B 35/14; F22B 33/18; F22B 33/185
See application file for complete search history.

(56) References Cited

U.S. PATENT DOCUMENTS 44,851 A 11/1864 Champlin
192,036 A 6/1877 Vanosdol
(Continued)

FOREIGN PATENT DOCUMENTS

GB 1382342 A 1/1975

*Primary Examiner* — Mark A Laurenzi
*Assistant Examiner* — Xiaoting Hu
(74) *Attorney, Agent, or Firm* — Grogan, Tuccillo & Vanderleeden, LLP

(57) ABSTRACT

A system for reheating a power generation system including a boiler having a waterwall and a steam drum with an input fluidly coupled to the waterwall and an auxiliary heat source to provide heated fluid. The system also includes a first flow control valve connected to the auxiliary heat source and the boiler to control a flow of heated fluid from the auxiliary heat source to the waterwall; a first isolation valve disposed at a waterwall, to isolate circulation of heated fluid from the steam drum to the waterwall; and a sensor to monitor at least one operating characteristic in the boiler. The system also includes a controller to control at least one of the flow control valve, the isolation valve, and the auxiliary heat source to control the amount of heated fluid supplied to the waterwall when the boiler is not generating steam.

20 Claims, 4 Drawing Sheets

(51) Int. Cl.

| | |
|---|---|
| ***F01K 13/00*** | (2006.01) |
| ***F01K 7/24*** | (2006.01) |
| ***F01K 3/24*** | (2006.01) |
| ***F22B 35/04*** | (2006.01) |
| ***F22B 33/18*** | (2006.01) |
| ***F01K 3/18*** | (2006.01) |

(56) References Cited

U.S. PATENT DOCUMENTS 3,163,009 A 12/1964 Rankin
3,164,134 A * 1/1965 Kochey, Jr. ..... F22B 29/12 122/406.5
3,169,373 A * 2/1965 Hanzalek ..... F01K 13/006 122/448.3
3,243,961 A * 4/1966 Caracristi ..... F22G 5/00 60/646
3,264,826 A * 8/1966 Kane ..... F01K 3/245 60/676
3,884,193 A * 5/1975 Bryers ..... F23C 10/00 122/4 D
4,048,012 A 9/1977 George et al.
5,029,443 A 7/1991 Hauser
5,396,865 A * 3/1995 Freeh ..... F22B 35/14 122/406.5
5,412,936 A 5/1995 Lee et al.
7,107,774 B2 9/2006 Radovich
8,276,382 B2 * 10/2012 Hu ..... F01K 23/101 60/657
8,573,196 B2 11/2013 Plotkin et al.
9,228,452 B2 1/2016 Terdalkar et al.
9,347,685 B2 5/2016 Plotkin et al.
9,803,504 B2 * 10/2017 Park ..... H02K 7/1823
2012/0031395 A1 * 2/2012 Plotkin ..... F24S 10/00 126/615
2013/0044851 A1 2/2013 Winters et al.
2013/0219888 A1 * 8/2013 Yang ..... F22B 1/006 60/641.1
2015/0192036 A1 * 7/2015 Sharp ..... F01K 23/10 60/39.182
2017/0058702 A1 * 3/2017 Park ..... F01D 17/145
2019/0284963 A1 * 9/2019 Ngo ..... F01K 13/02
2020/0056778 A1 * 2/2020 de Miranda Carvalho ..... F03G 6/067
2021/0285335 A1 * 9/2021 Mambro ..... F24H 7/02
2021/0285341 A1 * 9/2021 Mambro ..... F01K 19/00

* cited by examiner

SYSTEM AND METHOD FOR IMPROVING STARTUP TIME IN A FOSSIL-FUELED POWER GENERATION SYSTEM

BACKGROUND

Embodiments as described herein relate generally to existing or new combustion systems of a fossil-fueled power generation system and, more particularly, to a system and method for improving start up times in a power generation system having a fossil-fueled boiler and a steam turbine.

A boiler typically includes a furnace in which fuel is burned to generate heat to produce steam. The combustion of the fuel creates thermal energy or heat, which is used to heat and vaporize a liquid, such as water, which makes steam. The generated steam may be used to drive a turbine to generate electricity or to provide heat for other purposes. Fossil fuels, such as pulverized coal, oil, natural gas and the like are typical fuels used in many combustion systems for boilers. For example, in a pulverized coal-fired boiler, atmospheric air is fed into the furnace and mixed with the pulverized coal for combustion.

Boiler/piping/turbine thermal masses lend themselves well to the power markets that are capacity and base loaded to maintain operational efficiencies and component life-cycles. Today's power market is shifting from base load to cyclic and peak loading brought on by increasing participation of renewable energy sources. The emerging challenge facing many grid systems is grid stability associated with the sudden and cyclic electrical production profile of such renewable energy sources. As more and more renewable energy sources are added to the grid, there will be a greater need for operation of fossil fuel-fired power plants at low power and/or improve fast starting to assist stabilizing the grid.

Currently, large coal-fired power plants typically take 12 to 20 hours from cold to achieve 80% of their full-load rating. There are at least two main challenges to making large steam generation power plants more responsive to the fast-changing grid demands that require plants to startup and be generating 80% or more of their rated capacity in 30 minutes, not 12 to 20 hours. Firstly, boiler design pressure necessitates boiler/steam piping and turbine components fabricated of steel having large/thick cross sections. These heavy-walled components require the warming rates not to exceed, or not be faster than approximately 400° F./hour saturation temperature rise in the boiler and 100° F./hour steam turbine temperature rise. The reason for these maximum warming/cooling rates of change is to minimize thermal stresses in these respective components which ultimately is related to its useable service life. Secondly, in load cycling operations (from full rated capacity down to approximately 50% capacity and back up to full rated capacity–numerous times/day) the boiler and turbine systems, and their integrally connected components can be subjected to large temperature variations e.g., high pressure steam turbine and piping, superheater configurations and the like. These temperature variations can lead to drastic reduction in component life and the necessity for subsequent replacement. As a result, it is common to maintain temperatures and the reheat pressure at high levels in the plant in order to avoid imposing temperature related stresses on the boiler and turbine components. Therefore, it is desirable to maintain boiler system components at higher temperatures to reduce plant restart, warm-up, and even hot restart cycle times, while reducing stresses on plant components.

BRIEF DESCRIPTION

In an embodiment, described herein is a system for preheating a steam driven power generation system. The system includes a boiler system including a main boiler with a combustion system, the boiler system operative to generate steam when the combustion system is operative; a steam drum with an input fluidly coupled to the boiler; a superheater having an input and an output, the input of the superheater fluidly coupled to an output of the steam drum, the superheater operable to superheat steam generated in the boiler; a reheater having an input and an output, the reheater operable to reheat cooled expanded steam. The system further comprises: a plurality of steam pipes, the plurality of steam pipes including a first steam pipe having a first end fluidly connected to the output of the superheater, a second steam pipe and a third steam pipe; a turbine having at least a high pressure section and an intermediate pressure section, the turbine operable to receive steam and convert the steam to rotational power, wherein an input to the high pressure section is fluidly connected to a second end of the first steam pipe and operable to carry superheated steam from the superheater of the boiler system to the high pressure section of the turbine, wherein an output of the high pressure section is fluidly connected to a first end of the second steam pipe and a second end of the second steam pipe and is operable to carry cooled steam to the reheater, an output of the reheater is connected at a first end of the third steam pipe, and the second end of the third steam pipe is connected to an input of the intermediate pressure section and is operable to carry reheated steam from the reheater to the intermediate pressure section of the turbine; an auxiliary heat source operative to provide steam; a first flow control valve operable to control a flow of steam from the auxiliary heat source to the first steam pipe; a second flow control valve operable to control a flow of a steam from the auxiliary heat source to the third steam pipe; a first isolation valve disposed at a first end of the first steam pipe between the first steam pipe and the superheater, the first isolation valve operable to isolate flow associated with the boiler system in the first steam pipe; a second isolation valve disposed at the second end of the second steam pipe between the first steam pipe and the input to the reheater, the second isolation valve operable to isolate flow associated with the boiler system in the second steam pipe; a third isolation valve disposed at the first end of the third steam pipe between the third steam pipe and the output of the reheater, the third isolation valve operable to isolate flow associated with the boiler system in the third steam pipe; at least one electric heater operably configured to heat steam directed to the first steam pipe and the third steam pipe; a sensor, the sensor operable to monitor at least one operating characteristic in the boiler system; and a controller configured to receive information associated with the monitored operating characteristic and control at least one of the first flow control valve, the second flow control valve, the third flow control valve, the first isolation valve, the second isolation valve, the third isolation valve, and the auxiliary heat source and the electric heater to control the amount of steam supplied to the plurality of steam pipes and the turbine under selected conditions, and when the main boiler system is not generating steam.

In another embodiment, a system for reheating a power generation system is provided. The system comprises: a boiler system including a main boiler with a combustion system, the boiler system operative to generate steam when the combustion system is operating, the main boiler having a waterwall and at the top of the waterwall a steam drum is located with an input fluidly coupled to the waterwall; an auxiliary heat source operative to provide steam or hot water; a first flow control valve operably connected to the auxiliary heat source and the main boiler operable to control a flow of steam or hot water from the auxiliary heat source to the waterwall; a first isolation valve disposed at the waterwall, the first isolation valve operable, when closed, to isolate circulation of water from the steam drum to the waterwall of the boiler; a sensor operable to monitor at least one operating characteristic in the boiler system; and a controller configured to receive information associated with the monitored operating characteristic and control at least the first flow control valve, the first isolation valve, and the auxiliary heat source to control the amount of steam or hot water supplied to the waterwall under selected conditions when the boiler system is not generating steam.

In yet another embodiment, a method of preheating a power generation system is provided. The power generation system includes a boiler system having a main boiler and a combustion system, the boiler system operative to generate steam when the combustion system is operating, the main boiler having a waterwall and a steam drum located at a top region of the waterwall, the steam drum has an input fluidly coupled to the waterwall. The method of preheating the power generation system comprises: operably connecting an auxiliary heat source operative to provide steam or hot water to the boiler system; controlling a flow of steam or hot water from the auxiliary heat source to the waterwall of the main boiler with a flow control valve operably connected between the auxiliary heat source and the main boiler; isolating circulation of water from the steam drum to the waterwall of the boiler with an isolation valve disposed at a waterwall of the main boiler; monitoring at least one operating characteristic in the boiler system; receiving information associated with the monitored operating characteristic with a controller; and controlling with the controller at least one of the flow control valve, the isolation valve, and the auxiliary heat source to control the amount of steam or hot water supplied to the waterwall of the main boiler when the boiler system is not generating steam to warm the boiler.

Additional features and advantages are realized through the techniques of the present disclosure. Other embodiments and aspects of the disclosure are described in detail herein. For a better understanding of the disclosure with the advantages and the features, refer to the description and to the drawings.

BRIEF DESCRIPTION OF THE DRAWINGS

The described embodiments will be better understood from reading the following description of non-limiting embodiments, with reference to the attached drawings, wherein below.

DETAILED DESCRIPTION

Figure 1:
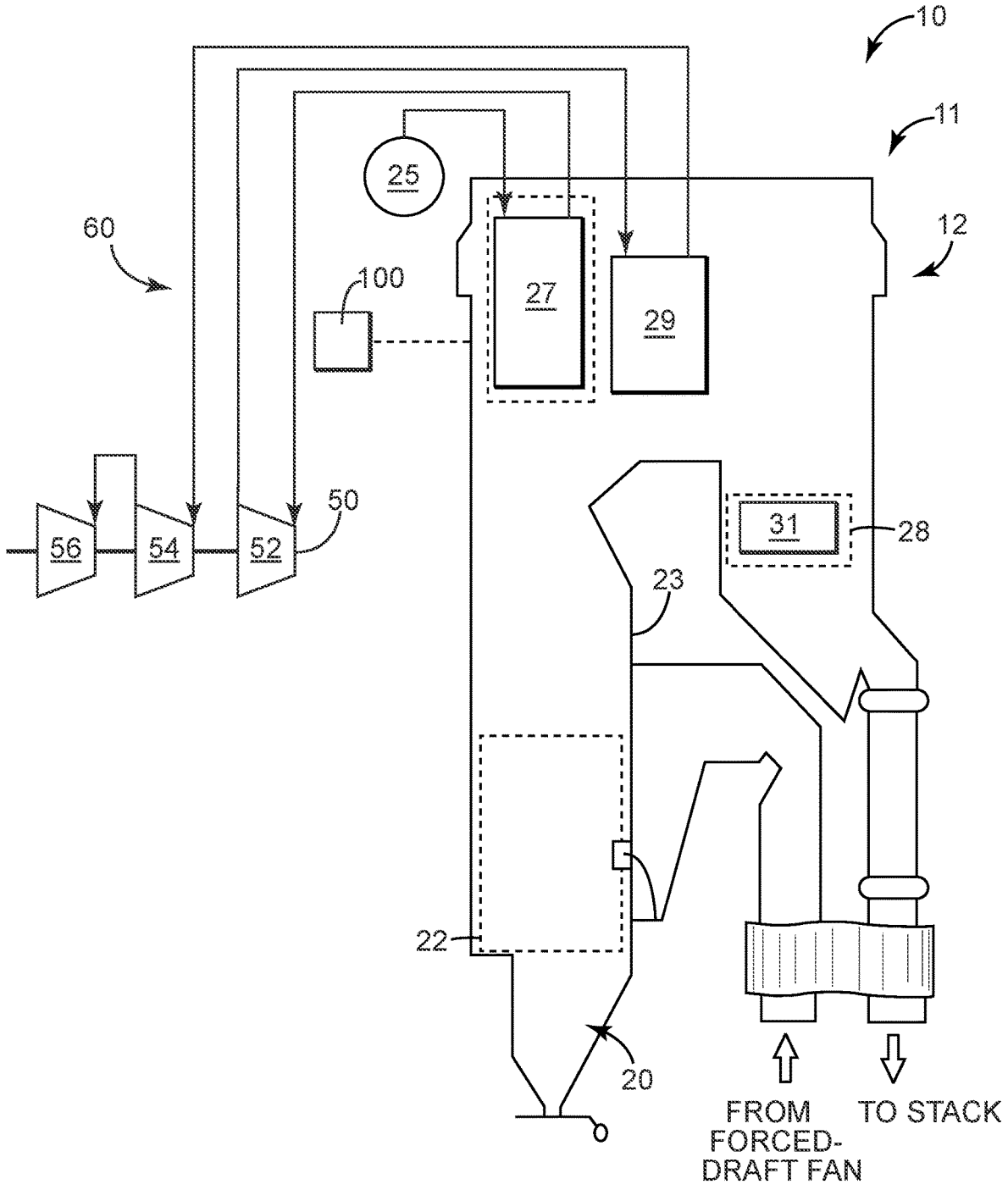
FIG. 1 is a simplified schematic illustration of a power generation system in accordance with an embodiment.

Reference will be made below in detail to exemplary embodiments as described herein, examples of which are illustrated in the accompanying drawings. Wherever possible, the same reference characters used throughout the drawings refer to the same or like parts. While the various embodiments as described herein are suitable for use with combustion systems, generally, a pulverized coal-fired boiler such as for use in a pulverized coal power plant has been selected and described for clarity of illustration. Other combustion systems may include other types of boilers, furnaces and fired heaters utilizing a wide range of fuels including, but not limited to, coal, oil and gas. For example, contemplated boilers include, but are not limited to, tangentially-fired (T-fired) and wall-fired pulverized coal boilers, circulating fluidized bed (CFB) and bubbling fluidized bed (BFB) boilers, stoker boilers, suspension burners for biomass boilers, dutch-oven boilers, hybrid suspension grate boilers, and fire-tube boilers. In addition, other combustion systems may include, but are not limited to, kiln, incinerator, fired heater and glass furnace combustion systems. Unless specified otherwise, the boiler operating conditions assumed and referenced throughout this disclosure includes the typical power plant steam drum operating pressure of 2650 psig, with superheat and reheat outlet steam temperatures of 1005 F, although this disclosure is applicable to all other operating temperature/pressure levels.

Embodiments as described herein relate to a power generation system having a combustion system and method and control scheme therefor that provides for reducing startup times and reduce cyclical thermal stresses in boiler systems. In particular, embodiments are related to a system and method that provides a controlled shut down of the power generation system and boiler, and a way to pre-warm and sustain warmth in a boiler/turbine/steam piping system when starting a power plant from cold conditions, and maintaining the pressure/temperature of the boiler/turbine/steam piping when re-starting a power plant from hot conditions. Pre-warming the boiler system components facilitates a much shorter time period to restart the boiler/steam piping/turbine, allowing the typical coal-fired power plant to be more responsive to sudden electrical grid demands. Furthermore, in periods of low grid energy demand, e.g., when grid demand is low (renewable energy contribution is high), it may be possible/desirable for some fossil fueled boilers to be required to reduce load or even discontinue operation as part of an effort to maintain and balance the electrical grid. In such cases, in accordance with one or more of the described embodiments, instead of cycling coal-fired plants to minimum load, a shutdown process is initiated and carried out with the intention to restart the plant within a span of several hours, e.g., 12 hours up to several days.

Boiler shutdown/restart in accordance with the described embodiments are initiated when the boiler/turbine is operating at approximately 50% to 70% MCR, or lower loads, at which time the boiler fires are extinguished (pulverizers cleared out), the turbine throttle valves closed, and the furnace is purged of flue gases, and a "hot banking" process is begun at high temperature and pressures. In some embodiments, the furnace/combustion system is purged and then tightly isolated to conserve this energy (hot banking a boiler). While not operating, the boiler pressures and temperature will slowly decay over time, however the described embodiments include a method of recovering this inevitable decay by providing warming sparging steam via a controlled admittance of sparging steam into the steam pipes, steam drum and lower drums, and indirectly, even the turbine. Steam is supplied in one instance, by a smaller auxiliary (aux.) boiler or by a secondary steam source (e.g., a solar steam source) to generate a steam drum pressure of the main boiler of approximately 500 psig without requiring the main boiler to be fired. The high pressure steam turbine warming requirement may be achieved and maintained with small steam flows from the auxiliary boiler/secondary steam source. Advantageously, the same steam used to keep the turbine hot will be used to keep the connected steam piping hot and pressurized in preparation for returning to producing electricity.

FIG. 1 illustrates a power generation system 10 including a combustion system 11 having a boiler 12 as may be employed in power generation applications. The boiler 12 may be a tangentially-fired, wall-fired, and industrial or an HRSG (heat recovery steam generator) or solar type boiler operating at supercritical or sub-critical pressures. The boiler employed may utilize a single or combination of types of fossil fuels or alternate heating sources releasing their energy into the boiler heat transfer surfaces. The boiler 12 includes ash hopper 20, the main burner 22, and a superheater 27 where steam can be superheated by the combustion flue gases. The boiler 12 also includes an economizer zone 28 with an economizer 31 where water can be preheated prior to entering a steam drum 25 or a mixing sphere (25), hereinafter called steam drum 25 to feed water to the waterwall 23. Pumps (not shown) may be employed to aid in circulating boiler water to the waterwall 23 and through boiler 12.

Generally, in operation of the power generation system 10 and combustion system 11, the combustion of fuel in the boiler 12 heats water in the waterwalls 23 of the boiler 12. A mixture of the heated water and steam from the waterwalls (boiler water) is collected in the steam drum 25 where the boiler water is not only mixed with incoming feedwater from the economizer 31, and steam is separated from the boiler water where it leaves the steam drum 25, which then passes to the superheater 27 where additional heat is imparted to the steam by the flue gases. The superheated steam from the superheater 27 is then directed via a piping system shown generally as 60 to a high pressure section 52 of a turbine 50, where the steam is expanded and cooled to drive turbine 50 and thereby turn a generator (not shown) to generate electricity. The expanded steam from the high pressure section 52 of the turbine 50 may then be returned to a reheater 29 to reheat the steam, which is then directed to an intermediate pressure section 54 of turbine 50, and ultimately a low pressure section 56 of the turbine 50 where the steam is successively expanded and cooled to drive turbine 50.

As illustrated in FIG. 1, the combustion system 11 includes an array of sensors, actuators and monitoring devices to monitor and control the combustion process. Furthermore, the power generation system 10 also includes an array of sensors, actuators and monitoring devices to monitor and control the heating processes associated with steam generation, and pre-warming in accordance with the described embodiments. For example, the power generation system 10 may include a plurality of fluid flow control devices (e.g., 94, 95 (FIG. 2)), that control the flow of steam in the system 10. In an embodiment, the fluid flow control devices may be electrically actuated valves that can be adjusted to vary the amount of flow therethrough. Each of the flow control devices is individually controllable by a controller 100.

Figure 2:
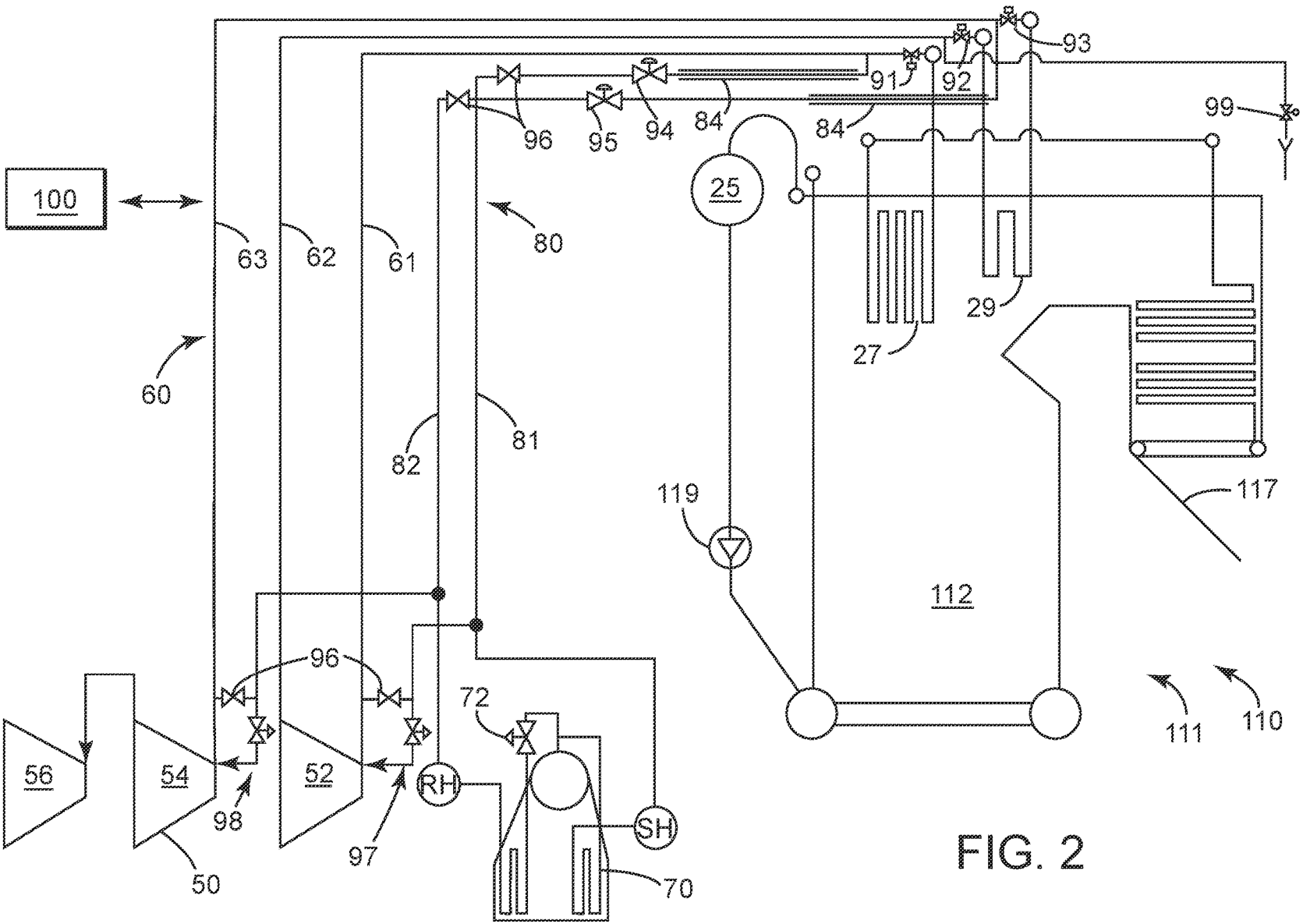
FIG. 2 is a schematic illustration of a boiler of the power generation system of FIG. 1, in accordance with an embodiment.

FIG. 2 depicts a simplified schematic of a system for heat loss-reduction and prewarming at least a portion of a power generation system 110 in accordance with an embodiment. The system and associated methodology provides a method to reduce heat loss in the boiler 112, and to prewarm and sustain operational characteristics, including, but not limited to temperature and pressure in at least the turbine 50 and steam piping system 60 interconnecting the boiler 112 and turbine 50. It may readily be appreciated that when starting the power generation system 110 from cold conditions any prewarming or conservation of energy will help reduce the overall warming, steam generation, power generation startup time, hereinafter referred to collectively as startup time. In addition, with the boiler 112 out of service and not generating steam, each of the components of the power generation system 110 will slowly begin to lose heat to the ambient. The rate of heat loss can vary significantly based on the ambient temperature, exterior temperature, the particular components, draft losses, as well as how well they are insulated. To that end, efforts taken to delay and reduce heat loss will improve the overall recovery capability and thereby start up time.

In an embodiment, a system configuration and methodology is described that provides for reducing heat losses and employing warming steam to maintain the operational characteristics, including, but not limited to temperature of the turbine 50 and interconnecting steam piping 60 when the boiler is at least initially not operating to facilitate re-starting the boiler 112 and power generation system 110. Prewarming facilitates a quicker restarting of the boiler 112 and ultimately the turbine 50, allowing the coal-fired power plant to be more responsive to sudden electrical grid demands. To address periods of low grid energy demand, some fossil-fueled power plants may be required to reduce load or even discontinue operation to balance the grid. In the latter case, the described embodiments provide for reductions of heat losses and ensure the provision of warming steam, thereby heating of the main steam piping e.g., 60 and the steam turbine 50. Such warming facilitates transitioning the boiler 112 to producing steam more rapidly, and thereby transitioning the power generation system 110 to electricity production more rapidly than conventional systems.

Continuing with FIG. 2, in a situation where the boiler is needed to be shutdown, (i.e., not generating steam), once the flue gases have been sufficiently purged, the circulation pump(s) 119 are stopped to prevent further heat losses throughout the system. Furthermore, boiler outlet isolation damper 117 is optionally employed and closed to eliminate or minimize further heat losses through draft effects in the combustion system 111. In an embodiment, the damper 117 is selected and configured to provide tight sealing of the exhaust flue of the boiler 112 to minimize/eliminate convection energy losses due to draft created by the connection of the combustion system with the draft inductance of the stack. The boiler outlet isolation damper 117 is a multi-louvered damper or isolation-type damper designed and manufactured for tight shut-off capability, though other configurations are possible.

The flue gas path is positively isolated by this damper 117 during all times subsequent to the completed furnace purge following shutdown of the boiler 112 and will remain closed until such time a restart of the boiler 112, is desired. However, the isolation damper 117 will remain closed during all pre-start/pre-warming operations until either the desired pressure/temperature in boiler 112 is attained or until a decision is reached to initiate the restarting of the pre-warmed boiler 112. At which time, the boiler outlet isolation damper 117 will only then be opened to startup the combustion air fans (not shown) to begin the required furnace purge process prior to initiating firing.

Continuing with FIG. 2, in an exemplary embodiment, an auxiliary boiler 70 is provided with associated piping, shown generally as 80 and isolation valves 94, 95, integrated into a power generation system 110 wherein common components are identified with common reference numbers. In an embodiment, the auxiliary boiler 70 ensures that the high pressure section 52 and a portion of the interconnect steam piping 60 associated with delivering steam to high pressure section 52, denoted as 61 and 62 respectively are maintained at a selected temperature and pressure with relatively small steam flows from the auxiliary boiler 70. Advantageously, the steam supplied by the auxiliary boiler 70 used to keep the high pressure section 52 and steam pipes 61, and 62 at a selected operational state or characteristics, including but not limited to temperature and pressure, and may also be employed to keep the connected steam pipes e.g., 61, 62, and 63 for the superheater 27 and reheater 29 hot and pressurized in preparation for returning the boiler 112 and turbine 50 to temperature for producing electricity.

In an embodiment the auxiliary boiler 70 is selected and configured as a much smaller boiler than the boiler 112 of the power generation system 110. For example, the auxiliary boiler 70 is rated to deliver primarily just enough energy to aid in warming the main steam pipes 61, 62, and 63 and at least the high pressure section 52 and optionally the intermediate pressure section 54 of turbine 50 as described herein. Generally, it would be expected for most power generation systems 110 that the required rating of auxiliary boilers 70 would be on the order of about 0.10 percent to 0.5 percent of the rating of the main boiler 112. The auxiliary boiler 70 may be configured to operate on any kind of fuel available, such as coal, oil, natural gas, electricity, and the like. It will be appreciated that a smaller boiler running near its designed capacity is at its most efficient and environmentally desirable state, compared to running a large main boiler 112 at very low levels. Hence, endeavoring to operate a large boiler at low levels is costlier due to less efficient transfer of its oil/gas fired energy into its boiler water to generate steam compared to a smaller boiler operating at its design rating. Therefore, an underlying theme of the described embodiments is to pragmatically employ a small, efficient heat source(s) as a means to keep all or a portion of the power generation system 110 at or near desired operating temperatures, (or at least as warm as is practical). Such steps are all targeted toward the goal of reducing and minimizing the time required to bring power onto the electrical grid system. The design steam flow rate of auxiliary boiler 70 needed for steam pipe and turbine warm-up from cold, or for maintaining steam pipe(s) 60 and turbine 50 at near their rated temperature(s)/pressure(s), is very small in comparison to the rating of the main boiler 112 because the only "work" the auxiliary boiler 70 steam will do is heat the steam pipes 60 and turbine 50 and maintain the steam piping 60 and turbine 50 at a selected temperature and pressure, (i.e., the sizing need not include any provision for producing electricity). The auxiliary boiler 70 need only be the aforementioned small percentage of the rating of the main boiler 112 since the steam piping 60 and turbine 50 will be isolated and typically very well insulated to conserve and retain the energy required from the auxiliary boiler 70. Further, maintaining operational characteristics, including, but not limited to the temperature of the main steam pipes 61, 62, and 63 and at least the high pressure section 52 of turbine 50, controls and more closely matches the steam temperature from the auxiliary boiler 70 with the temperatures of the critical components of turbine 50, avoiding continuous temperature variations and gradients, that will not only improve startup temperature control, but additionally reduce cold start thermal stresses which could otherwise negatively impact the overall life cycle of the turbine 50 and combustion system 110 components.

In an embodiment, steam from the auxiliary boiler 70 is configured with one or more heating paths that may be independently distributed. For example, the auxiliary boiler 70 may employ a single steam output routed as desired in the power generation system 110 in series. Likewise, the auxiliary boiler 70 may employ a plurality of steam outputs routed as desired in the power generation system 110 in parallel to a plurality of locations. In an embodiment, the auxiliary boiler 70 is depicted as employing two steam outputs with one routed to the steam piping e.g., 61, 62 associated with the superheater 27 and high pressure section 52, an another routed at lower pressure to the steam piping e.g., 63 associated with the reheater 29. In an embodiment, steam from the auxiliary boiler 70 is directed via line 81 through flow control valve 94 to the superheater end of the steam pipe 61. Isolation valve 91 associated with the superheater 27 separates the superheater 27 from the flow. The steam passes through steam pipe 61 to the high pressure section 52 warming the high pressure section of turbine 50. Subsequently the steam returns through steam pipe 62 to the isolation valve 92 and then passes to a drain and the hot well (not shown) via thermal drain valve 99 to ultimately be recirculated. Similarly, along another path, steam from the auxiliary boiler 70 at a selected, limited lower pressure, is directed via line 82 through flow control valve 95 to the reheater end of the steam pipe 63. Isolation valve 93 associated with the reheater 29 ensures that the reheater is separated from the flow. The steam passes through steam pipe 63 to the intermediate pressure section 54 thereby warming the intermediate pressure section 54. Subsequently the steam passes to the low-pressure section 56 and returns to drain and the hot well (not shown) to be recirculated.

In an exemplary embodiment, lines 81 and 82 include flow control valves 94 and 95 respectively, to regulate and control the flow of steam in the two paths from the auxiliary boiler 70 while check valves 96 ensure isolation and proper directional flow of the steam. Moreover, during normal operation of the power generation system 110 and boiler 112, the check valves 96 and flow control valves 94, 95 isolate the auxiliary boiler 70 from the high pressures of the boiler. In addition, lines 81 and 82 also include electric heaters 84 to further heat the steam from the auxiliary boiler 70 when necessary and aid in warming the steam piping 60 and maintaining heat in the system 110 for selected modes of operation. In an embodiment, the auxiliary boiler 70 is configured to provide steam at a first temperature for heating, while the electric heaters 84 are configured to provide additional heating to the steam from the auxiliary boiler 70 to heat the steam piping 60 to higher levels above that of the auxiliary boiler 70. For example, to provide additional heating for certain starting modes of the boiler 112. In an embodiment, the auxiliary boiler 70 is configured to provide steam at about 500° F., while the heaters 84 are configured to controllably increase the temperature as needed to warm the steam piping 60 without exceeding the constraints for the materials employed. Similarly, under selected conditions, flow control valves 97 and 98, permit flow of steam directly from auxiliary boiler 70 (or the main boiler 112) to the turbine 50 in advance of the warming of the steam pipes 61, 62, and 63 to prewarm the turbine 50 alone. Check valves 96 ensure isolation and proper directional flow of the steam. In an embodiment, each of the lines 81 and 82 feeding high pressure steam and lower pressure steam respectively branches off to a connection at the inlet to the high pressure section 52 and the inlet to the intermediate pressure section 54 respectively, for the purposes of pre-warming the turbine 50, separately, if/when needed. Flow control valves 97 and 98 respectively are provided to allow warming of the respective turbine sections (e.g., 52, 54) separately from the main steam piping 60 if so chosen by control room operators. In an embodiment, the connection point of the outlet of the valves 97, 98 will be the tie-in to the existing turbine warming control valve(s). In operation, warming steam will fill the turbine section to the desired pressure and temperature, and temperature rise rates as recommended by the turbine manufacturer. As the steam releases its energy the steam condenses and is drained out of the turbine via existing casing and throttle drain valves and into the existing condenser (not shown), and into the existing hot well. Once in the hot well, the condensate is recirculated.

Figure 3:
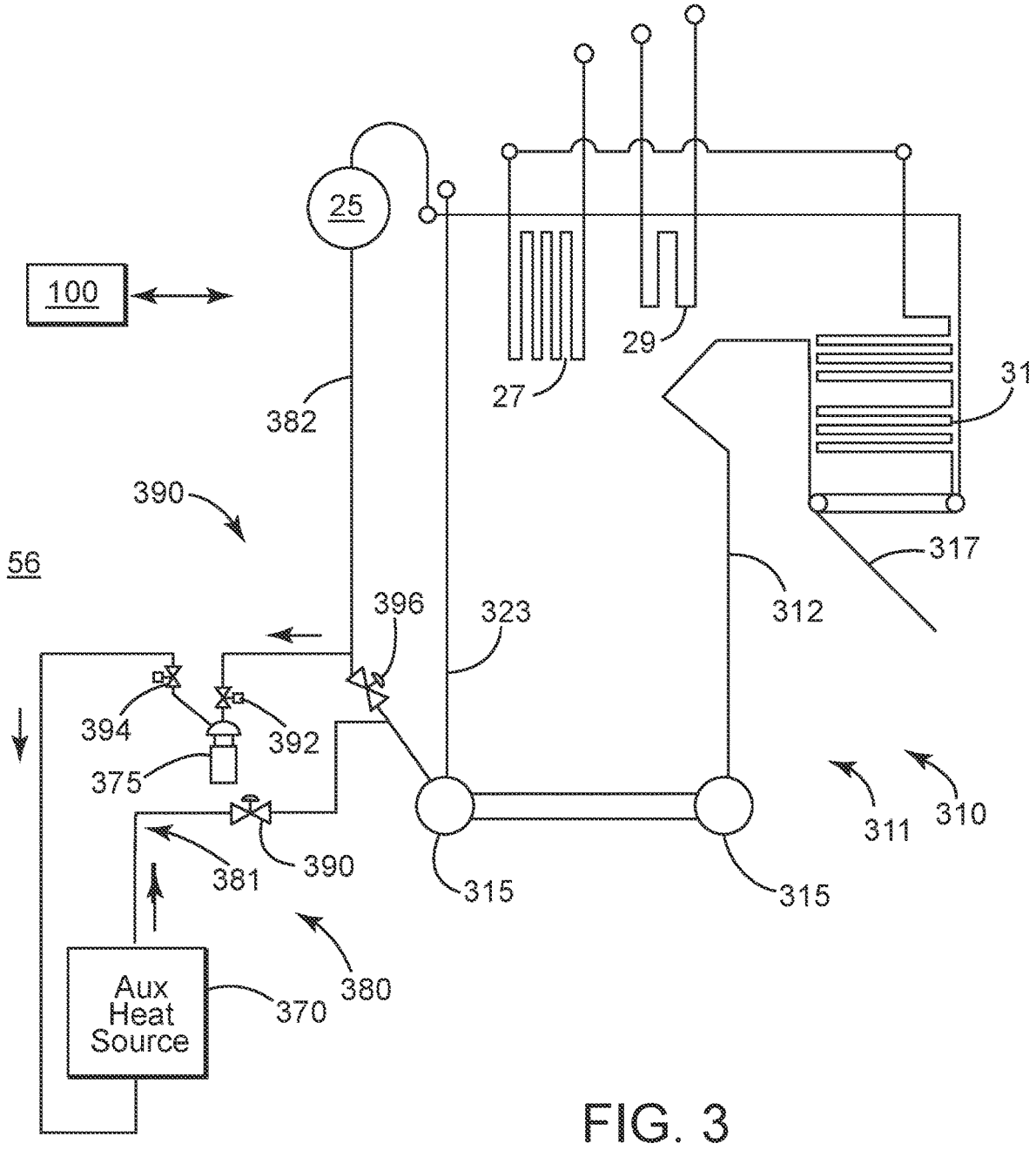
FIG. 3 is a schematic illustration of a boiler of the power generation system, in accordance with another embodiment.

FIG. 3 depicts a simplified schematic of system for prewarming at least a portion of a power generation system 310, wherein common elements from FIGS. 1 and 2 are referred to with common reference numerals and the elements that may be similar yet associated with this embodiment are incremented by 300 to identify their distinction. The power generation system 310 and associated methodology provides a way to reduce heat losses and prewarm and sustain operational characteristics, including, but not limited to temperatures and pressures in the boiler 312, waterwall 323 and steam drum 25, when the boiler 312 is not operating, which, for example, may be the same as the boiler 12 and steam drum 25 of FIG. 1 yet adapted or modified to this embodiment's application. Once again, with the boiler 312 not operating (i.e., not generating steam), each of the components of the power generation system 310 will slowly begin to lose heat/pressure to the ambient. Prewarming facilitates a quicker restarting of the boiler 312, and ultimately providing steam to the turbine 50 allowing the typical coal-fired power plant to be more responsive to sudden electrical grid demands. As stated above, in order to address periods of low grid energy demand, some fossil fueled power plants may be required to reduce load or even discontinue operation to balance the grid. In the latter case, the described embodiments ensure the provision of warming water or steam, thereby heating of the boiler and steam drum 25. Such warming facilitates transitioning the boiler 312 to producing steam more rapidly, and thereby transitioning the power generation system 310 to electricity production more rapidly than conventional systems. While the described embodiments are directed toward natural circulation boilers employing convection heating and circulation, such descriptions are merely examples. The described embodiments may readily be employed and applied to controlled circulation and supercritical boilers optionally employing the described circulation or their internal circulation systems to facilitate the warming as will be appreciated by those skilled in the art. Furthermore, while the described embodiments are directed to employing hot water heating in the auxiliary heat source 370, it should be appreciated that steam may also be employed as described herein with requisite modifications to include steam sparging as needed for mixing the steam and hot water in the boiler 312.

Continuing with FIG. 3, in an embodiment the boiler is shut down (not generating steam). Once the flue gases have been sufficiently purged, optionally, the circulation pump(s) (if so equipped) are stopped to prevent further heat losses throughout the system. Furthermore, damper 317 is optionally employed and closed to avoid further heat losses through draft effects in the combustion system 311. In an embodiment, the damper 317 is selected and configured to provide tight sealing of the exhaust flue of the boiler 312 to minimize draft losses. In an embodiment the damper 317 is located in the boiler outlet duct before flue gases enter the air preheater (not shown) or a SCR (Selective Catalytic Reducer) (not shown) as the case maybe. It should be appreciated that an air preheater and SCR are commonly connected flue gas equipment in combustions systems, but lie outside the combustion boundary and are not a subject of the described embodiments. The gas outlet damper 317, along with combustion air fan inlet louver and outlet isolation dampers will effectively close-off the convective forces of the connected stack. An auxiliary heat source 370 is provided with associated piping, shown generally as 380 and valves 390, 396, integrated into a power generation system 310. The auxiliary heat source 370 ensures that the boiler 312, waterwall 323 and steam drum 25 respectively are maintained at a selected temperature and pressure with small steam flows from the auxiliary heat source 370.

In an embodiment, the auxiliary heat source 370 is selected and configured as a much smaller rated boiler than the boiler 312 of the power generation system 310. For example, the auxiliary heat source 370 is sized just sufficiently large enough to aid in warming the boiler 312 and steam drum 25 as described herein. Generally, it would be expected for most power generation systems 310 that the auxiliary heat source 370 would be on the order of about 0.3 percent to 2.0 percent of the size of the main boiler 312 though other sizes are possible depending on the heating requirements, insulation, ambient temperatures, size of the boiler, and the like. The auxiliary heat source 370 may be configured to operate on any kind of fuel available and coal, oil, natural gas, electricity, and the like. In an embodiment, the auxiliary heat source is a boiler. In another embodiment, the auxiliary heat source 370 is an electric heater. It will be appreciated that a smaller boiler running near capacity is at its most efficient and environmentally desirable state. Conversely, endeavoring to operate a large boiler e.g., boiler 312, at low capacity levels is less desirable, namely based on control functionality, efficiency, component life expectancy, and environmental considerations. Therefore, an underlying theme of the described embodiments is to pragmatically employ a small, efficient heat source(s), or the residual heat energy within the main boiler, as a means to keep all or a portion of the power generation system 310 at or near desired operating temperatures, (or at least as warm as is practical). Such steps are all targeted toward the goal of reducing and minimizing the time required to bring the power generation system 310 to power generation capability. Further, maintaining temperature of the main boiler 312 and steam drum 25 avoids repeated temperature variations and gradients that can impact the overall life cycle of the power generation system 310 components.

In an embodiment, steam or hot water from the auxiliary heat source 370 is configured with one or more heating paths that may be independently distributed. For example, the auxiliary heat source 370 may employ a single hot water or steam output routed as desired in the power generation system 310 in series. Likewise, the auxiliary heat source 370 may employ a plurality of hot water or steam outputs routed as desired in the power generation system 310 in parallel to a plurality of locations. In an embodiment, the auxiliary heat source 370 is depicted as employing a single hot water output routed via selected valving to the boiler 312. In an embodiment, steam or hot water from the auxiliary heat source 370 is directed via line 381 through flow control valve 390 to the waterwall of the boiler 312. In the instance of the auxiliary heat source 370 supplying steam, a sparger 315 may be employed to facilitate mixing the steam at the waterwall 323. In an embodiment, it should be appreciated that if steam is the chosen heat source for boiler 3570, some modifications/additions to the system of FIG. 3 will likely be required, including but not limited to, addition of a sparger/mixing chamber, employing auxiliary heat source 370 as a steam boiler with separating drum, or operating at higher head/lower capacity circulation pump. In addition, a recirculation pump would need a bypass or a recirculation line to allow control of the drum level during boiler startup for the auxiliary heat source 370 when operating as a steam boiler, and a check valve downstream of the flow control valve 390 to prevent backflow of water from main boiler 312.

Isolation valve 396 isolates the normal path for water from the steam drum 25 to the optional sparger 315 and/or the inlet of the waterwall 323. The steam or hot water passes through waterwall 323 to the steam drum 25, subsequently returning from the steam drum 25 via line 382 to pump 375 and then returns to the auxiliary heat source 370 to be reheated and recirculated. Isolation valves 392, 394 and flow control valve 390 facilitate isolating the pump 375, the auxiliary heat source 370 from the boiler under selected operating conditions and during normal operations of the boiler 312 to avoid exposing the auxiliary heat source 370 to the high pressures associated with the operation of the boiler 312 and to not impede the natural circulation of the boiler 312 during normal operation.

Figure 4:
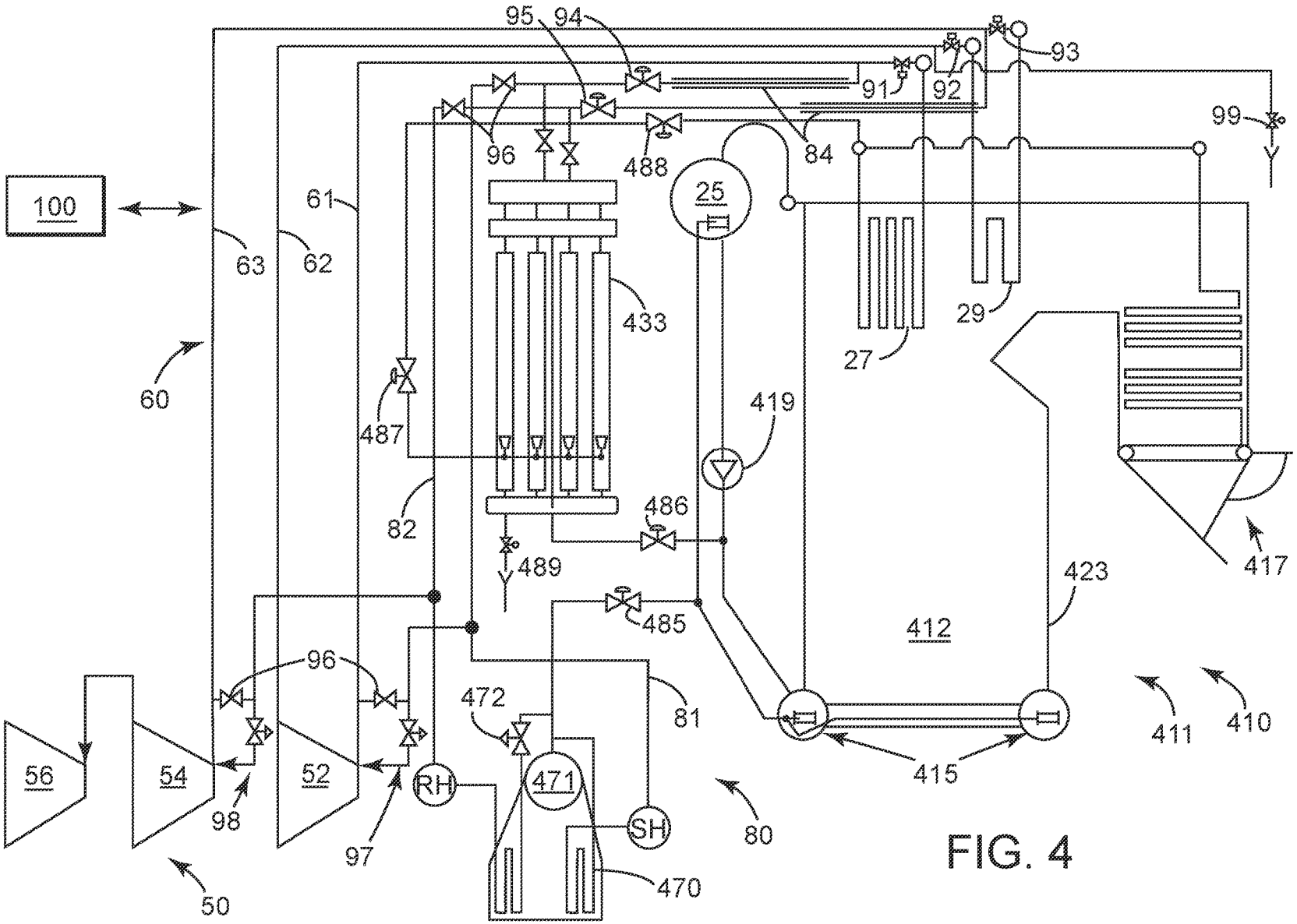
FIG. 4 is a schematic illustration of a boiler of the power generation system, in accordance with another embodiment.

FIG. 4 depicts a simplified schematic of a system for heat loss reduction and prewarming at least a portion of a power generation system 410 in accordance with an embodiment. The system and associated methodology provides a way to reduce heat loss in the boiler 412, and to prewarm and sustain operational characteristics, including, but not limited to temperature and pressure in at least one of the boiler 412, the turbine 50 and steam piping system 60 interconnecting the boiler 412 and turbine 50. It may readily be appreciated that when starting a power generation system 410 from cold conditions, any prewarming will help reduce the overall warming, steam generation, and power generation startup time, hereinafter referred to collectively as startup time. In addition, with the boiler 412 not operating, each of the components of the power generation system 410 will slowly begin to lose heat to the ambient. The rate of heat loss can vary significantly based on the ambient temperature, exterior temperature, the particular components, as well as how well they are insulated. To that end, efforts taken to delay and reduce heat loss will improve the overall recovery capability and thereby start up time.

In an embodiment, a system configuration and methodology is described that provides for reducing heat losses and employing warming steam to maintain the temperature of the turbine 50 and interconnecting steam piping 60 when the boiler is initially inoperative to facilitate re-starting the boiler 412 and power generation system 410. Prewarming facilitates a quicker restarting of the boiler 412 and ultimately the turbine 50, allowing the power plant to be more responsive to sudden electrical grid demands. The described embodiments provide for reductions of heat losses and ensure the provision of a warming steam, thereby heating of the boiler 412, main steam piping e.g., 60 and the steam turbine 50. Such warming facilitates transitioning the boiler 412 to producing steam more rapidly, and thereby transitioning the power generation system 410 to electricity production more rapidly than conventional systems.

Continuing with FIG. 4, the boiler 412 is shut down and not operating. Once the flue gases have been sufficiently purged, optionally, the circulation pump(s) 419 are stopped to prevent further heat losses throughout the system. Furthermore, damper 417 is closed to avoid further heat losses through draft effects in the combustion system 411. In an embodiment, the damper 417 is selected and configured to provide tight sealing of the exhaust flue of the boiler 412 to minimize draft losses. The damper 417 is located in the boiler outlet duct before entering the air preheater (not shown) or the SCR (not shown). An air preheater and SCR are connected flue gas equipment, but lie outside the combustion boundary and are not part of the described embodiments. The gas outlet damper, along with a combustion air fan inlet louver and outlet isolation dampers will effectively close-off the convective forces of the connected stack. Once again in an exemplary embodiment, an auxiliary boiler 470 is provided with associated piping, shown generally as 80 and isolation valves 91-99, integrated into a power generation system 410 wherein common components are identified with common reference numbers. In an embodiment the auxiliary boiler 470 ensures that temperatures and pressures are maintained in the boiler 412, by providing warming sparging steam via a controlled admittance of sparging steam into the steam drum 25 and lower drums with spargers 415 to feed the boiler 412 and warm the waterwalls 423. In an embodiment, steam may be supplied by the auxiliary boiler 470 sufficiently to generate and maintain pressures in the steam drum 25 of about 500 psig. Advantageously, the steam supplied by the auxiliary boiler 470 is used to keep boiler 412, steam drum 25, high pressure section 52 and steam pipes 61 and 62 at a selected temperature and pressure, and may also be employed to keep the connected steam piping 61, 62, and 63 for the superheater 27 and reheater 29 hot and pressurized in preparation for returning the boiler 412 to service to enable the production of electricity with minimal or reduced delays.

The auxiliary boiler 470 is selected and configured as a much smaller boiler than the boiler 4712 of the power generation system 410. For example, the auxiliary boiler 470 is sized sufficiently large enough just to aid in warming the boiler 412, steam drum 25, main steam pipes 61, 62, and 63 and at least the high pressure section 52 of turbine 50 as described herein. Generally, it would be expected for most power generation systems 410 that the auxiliary boilers 470 would be on the order of about 3 percent to 10 percent of the size of the main boiler 412. In another embodiment, the auxiliary boiler would be on the order of about 5 percent to 8 percent of the capacity of the boiler 412. The auxiliary boiler 470 may be configured to operate on any kind of fuel available, such as coal, oil, natural gas, electricity, and the like. It will be appreciated that a smaller boiler running near capacity is at its most efficient and environmentally desirable state. Conversely, endeavoring to operate a large boiler at low capacity levels is difficult from a control, efficiency and environmental considerations. Therefore, an underlying theme of the described embodiments is to pragmatically employ a small, efficient heat source(s) as a means to keep all or a portion of the power generation system 410 at or near desired operating temperatures. Such steps are all targeted toward the goal of reducing and minimizing the time required to bring the power generation system 410 to power generation capability (and to reduce the stresses caused by cyclical heating that lead to a reduction of life for the boiler components.). Further, maintaining temperature of the boiler 412, steam drum 25, main steam pipes 61, 62, and 63 and at least the high pressure section 52 of turbine 50 avoids the continuous temperature variations and gradients that can impact the overall life cycle of the turbine 50 and boiler system 40 components.

In an embodiment, steam from the auxiliary boiler 470 is configured with one or more heating paths that may be independently distributed. For example, the auxiliary boiler 470 may employ a single steam output routed as desired in the power generation system 410 in series. Likewise, the auxiliary boiler 470 may employ a plurality of steam outputs routed as desired in the power generation system 410 in parallel to a plurality of locations. In an embodiment, the auxiliary boiler 470 is depicted as employing two steam outputs with one routed to the steam piping e.g., 61, 62 associated with the superheater 27 and high pressure section 52, and another routed to the steam piping 63 associated with the reheater 29. In an embodiment, steam from the auxiliary boiler 470 is directed via line 81 through flow control valve 94 to the superheater end of the steam pipe 61. Isolation valve 91 associated with the superheater 27 separates the superheater 27 from the flow. The steam passes through steam pipe 61 to the high pressure turbine 52 warming the high pressure turbine. Subsequently the steam returns through steam pipe 62 to the isolation valve 92 and then passes to drain and the hot well (not shown) via thermal drain valve 99 to ultimately be recirculated. Similarly, along another path, steam from the auxiliary boiler 470 at a selected, limited lower pressure, is directed via line 82 through flow control valve 95 to the reheater end of the steam pipe 63. Isolation valve 93 associated with the reheater 29 ensures that the reheater is separated from the flow. The steam passes through steam pipe 63 to the intermediate pressure section 54 warming the steam pipe 63, and the intermediate pressure section 54. Subsequently the steam passes to the low pressure section 56 and returns to drain and the condenser/hot well (not shown) to be recirculated.

In an embodiment, lines 81 and 82 include flow control valves 94 and 95 respectively, to regulate and control the flow of steam in the two paths from the auxiliary boiler 470 while check valves 96 ensure isolation and proper directional flow of the steam. Moreover, during normal operation of the power generation system 410 and boiler 412, the check valves 96 and flow control valves 94, 95 isolate the auxiliary boiler 470 from the high pressures of the boiler. In addition, lines 81 and 82 may also include electric heaters 84 to further heat the steam from the auxiliary boiler 4770 and aid in warming the steam pipes 60 and maintaining heat in the system 410 for selected modes of operation. In an embodiment, the auxiliary boiler 470 is configured to provide steam at a first temperature for heating, while the electric heaters 84 are configured to provide additional heating to the steam from the auxiliary boiler 470 to heat the steam pipes 60. For example, to provide additional heating for certain starting modes of the boiler 12. In an embodiment, the auxiliary boiler 470 is configured to provide steam at about 500° F., while the heaters 84 are configured to controllably increase the temperature as needed to warm the steam pipes 60 without exceeding the design temperatures for the materials employed. Similarly, under selected conditions, flow control valves 97 and 98, permit flow of steam directly from auxiliary boiler 470 (or the main boiler 12 not shown) to the turbine 50 in advance of the warming of the steam pipes 61, 62, and 63 to prewarm the turbine 50 alone. Check valves 96 ensure isolation and proper directional flow of the steam. In an embodiment, each of the lines 81 and 82 feed high pressure steam and lower pressure steam respectively branches off to a connection at the inlet to the high pressure section 52 and the inlet to the intermediate pressure section 54 respectively, for the purposes of pre-warming the turbine 50, separately, if/when needed. Flow control valves 97 and 98 are provided to allow warming of the respective turbine sections (e.g., 52, 54) separately from the main steam piping 60 if so chosen by control room operators. In an embodiment, the connection points of the outlet of the valves 97, 98 will be the tie-in to the existing turbine warming control valve(s). In operation, warming steam will fill the turbine to the pressures and temperature, and temperature rise rates as recommended by the turbine manufacturer. As the steam releases its energy the steam condenses and is drained out of the turbine via existing casing and throttle drain valves and into the existing condenser (not shown), and into the existing hot well. Once in the hot well, the condensate is recirculated.

Continuing with FIG. 4, in an embodiment, the auxiliary boiler 470 also ensures that the boiler 412, waterwall 423 and steam drum 25, respectively, are maintained at a selected temperature and pressure with small steam flows from the auxiliary boiler 470. In an embodiment, steam from the high pressure side of the auxiliary boiler 470 is directed via line 81 through flow control valve 485 to the waterwall the boiler 412. Sparger(s) or drums 415 may be employed to facilitate mixing the steam at the waterwall 423 as well as in the steam drum 25 as needed to maintain or increase the temperatures and pressures therein to facilitate restarting the main boiler 412. Advantageously, while the waterwall 423 and drum are maintained at temperature and pressure, the superheater 27 and reheater 29 are also heated by virtue of convection from the heated waterwall 423. Flow control valve 485 also facilitates isolating the auxiliary boiler 470 from the boiler 412 under selected operating conditions and during normal operations of the boiler 412 to avoid exposing the auxiliary boiler 470 to the high pressures associated with the operation of the main boiler 412.

Continuing with FIG. 4, in an embodiment, one or more accumulators 433 with spargers are optionally employed to store condensate at increased temperature and pressure. In an embodiment, the accumulators 433 are intended to begin charging after the main boiler 412 fires are extinguished and steam drum 25 pressure has decayed to about 75% of its design operating pressure to capture some of the energy remaining in the system 410. Under such conditions, the turbine 50 may still be producing some power with boiler 412 combustion extinguished. At which time, the steam turbine will have already begun its shutdown process and its throttle valves nearing closed position. Simultaneously, the turbine valves (not shown) begin to close as the accumulator flow control valve 487 begins to open, thereby charging the partially filled accumulator 433 already controlled at about 1000 psig. As a result, the steam from the superheater 27 is condensed by the condensate residing in the accumulators 433. The accumulator pressure will continue to build by virtue of any remaining residual heat from the boiler 412. In one embodiment, if the pressure in the accumulator 433 begins to decay before attaining a select charge pressure all accumulator isolation valves e.g., 486, 487,488, 489 are closed as the maximum charge has been achieved. In an embodiment a target pressure of 2000 psig is employed, though other pressures are possible. Furthermore, in an embodiment, if the boiler 412 steam drum pressure has begun to decay or is at about 95% of its rated pressure, valves 91, 92 and 93 may be closed to start the hot standby period. The gas outlet damper 417 and the circulation pumps 419 may be shut/shutdown to conserve the residual furnace heat. The above process is designed and controlled by the combustion system 411 based on specific ratings and capacities of any particular size boiler 412 and the system 410.

In one embodiment, the accumulators 433 begin charging via the control valve 487 from an initial control pressure of 1000 psig up to the highest pressure possible, but in no case, no higher than the accumulator maximum operating pressure of 2000 psig. When the maximum achievable accumulator pressure is reached, the control valve 487 is closed and the accumulators will then have been deemed, "fully charged." Over time, as the accumulator releases its contained energy through the check valve, the accumulator pressure will decay gradually. When the accumulator pressure drops to less than 500 psig, the accumulators will be recharged via the auxiliary/alternate energy source up to the source's maximum operating pressure, but in no case, greater than 2000 psig. In one embodiment, the auxiliary/alternate energy source maximum operating pressure can be a minimum of 1500 psig.

Continuing with FIG. 4, in an embodiment, one or more accumulators 433 with spargers are optionally employed to store condensate at increased temperature and pressure for the purpose of improved restarting of the boiler 412 following a period of time boiler 412 has not been operating for at least several days. When restarting boiler 412, heated, pressurized, condensate from the accumulators 433 may be employed for continued boiler 412 prewarming, at the same time the condensate water in the accumulator 433 also can be used to provide an expeditious method of improving the boiler water quality of the main boiler 412 via use of the accumulator drain valve 486. In addition, condensate water level in the accumulators 433 may be maintained by either the auxiliary boiler 470 via valve 486 and 488, or the main boiler 412 by valve 488 or valve 487. Utilizing, the stored condensate if and only when needed during startup of main boiler 412 aids in minimizing the startup time by reducing the associated boiler water blowdown delay periods as are typically experienced in the industry. Furthermore, during startup of boiler 412, stored steam from the accumulator 433 can be routed via control valve 486 to spargers in the lower drum 415 and steam drum 25 of boiler 412 for pre-warming At the same time, a small quantity of steam from accumulator 433 is routed to steam piping 61 and reheat piping 62 by opening control valves 94 and 95. For startup purposes, the accumulator 433 can act independently as a source for warming or supplementary steam and make up water in conjunction with auxiliary boiler 470. For keeping warm, the accumulator 43 can act independently until auxiliary boiler 770 is called upon for steam as the accumulator 433 depletes its energy.

In an embodiment, in operation, steam from the auxiliary boiler 470 is directed to multiple paths. For example, in an embodiment as many as three primary steam paths are employed, simultaneously or separately, with controllable and variable flowrates as is necessary for a selected mode of operation. In one embodiment a large pipe (e.g., about 8" in diameter) is routed from the top of the auxiliary boiler steam drum denoted 471, to the sparging steam flow control valve 485. Downstream of flow control valve 485, the steam flow may be divided into two paths, one directed to the main boiler steam drum 25, the other directed to the lower drum(s) 415 or crossover pipe between them. The distribution of steam flow to each drums (e.g., 25, 415) may be controlled by internal flow orifices (not shown) sized to plant specific design requirements.

In another embodiment, a second and third flow path direct steam from the auxiliary steam drum 471 ultimately to the main steam piping (e.g., 61 and 63) to warm the main steam piping, or in addition or alternately to the high pressure section 52, or intermediate pressure section 54 of the turbine 50, respectively. In an embodiment this second flow path is directing the steam from the steam drum 471 of the auxiliary boiler 470 to a pressure control valve 472 to reduce the pressure for the reheater path and the intermediate pressure section 54 of the turbine 50. In an embodiment the warming steam is then returned to the auxiliary boiler 470 where the steam is superheated by about 100° F., flowing into a collection header (indicated by RH). The steam flow can then be directed to the intermediate pressure section 54 of the turbine 50 thru the existing steam valve 98, and/or the steam can be directed to the reheater steam pipe 63, first flowing through a connected check valve 96, then through the steam flow control valve 95, then through an electric steam heater 84, then terminating in steam line 63 as described previously herein. In an embodiment, the size of the steam supply pipe 82 may be approximately 2" diameter, with a 1½" connection at the tie-in point into the large steam pipe (63). Steam flow enters the steam pipe (63 releasing its energy and flows into the inlet of the out of service intermediated pressure section 54 of the turbine 50, through the warming steam valve 98. As the steam warms the intermediate pressure section 54 of turbine 50 some of the steam condenses and is removed by existing turbine drain valves (not shown) to the condenser, then to the hot well (not shown), where the water is returned to the auxiliary boiler (470) or stored as needed. The temperature of warming steam entering the intermediate pressure section 54 of the turbine 50 is monitored to ensure turbine temperature and pressure constraints are not exceeded. Warming steam temperature control may be accomplished by either introducing "tempering steam" through control valve 96 into the steam pipes (e.g., 61 or 63), and/or controlling the heating provided by the electric steam heaters 84.

In an embodiment, a third warming steam flow path for the steam pipes 61 is connected to the superheater 29 and similar to that described above with two variations. The steam flow path via steam pipe 81 does not utilize a pressure control valve (as does the reheater warming steam flow path via steam pipe 82) in that this path is designed and configured for the higher operating temperatures and pressures of the superheater 27. Similarly, a portion of the warming steam entering the high pressure section 52 of the turbine 50 is directed into the steam pipe 62, whereby remaining steam energy warms steam pipe 62. In addition, the second variation is that in an embodiment, the auxiliary boiler 470 provides steam to the main boiler 412 and the steam piping 60 and the steam turbine 50. Warming and charging steam is directed into the accumulators 433, via the boiler 412 and superheater 27. There is a check valve in the economizer feedwater piping to prevent backflow of feedwater. Steam flow is directed through the flow control valve 487, and directed into the steam spargers (not shown) located near the base of the vertically arranged accumulators 433. In an embodiment, the accumulator includes a plurality of vertically arranged accumulators, and steam/water flow is directed to a horizontally arranged hot holding drum (not shown), and steam/water is directed to a second horizontally arranged steam separation drum where a water level is controlled. In an embodiment, controller 100 implements a process that includes manipulating control valves 487, 94, 95, 488, 486 and 489 to control the steam flows and water levels. In one implementation, the hot holding drum is connected to the cold holding drum by a downcomer pipe, which serves to provide a natural circulation flow within the accumulator 433 is being charged, improving condensing efficiency. The steam is separated in the upper most horizontal drum. The uppermost horizontal drum is the steam separating drum, and the hot holding drum is beneath the separating drum. There are a total of three (3) outlet steam flow paths exiting at the top of the separating steam drum. One steam flow path is directed to the superheater steam pipe 61, through flow control valve 94. The second steam flow path is directed to the reheater steam pipe 63, through flow control valve 95. Pressure reducing control valve 472 comes into service only when the auxiliary boiler 470 is in service.

The third and final steam flow path is to the main boiler steam drum 25 via flow control valve 487, wherein the steam flow is directed into a manifold (not shown), which is positioned below the normal water level internal to the steam drum 25 and equipped with several steam spargers (not shown) submerged below the water level providing a release of accumulator energy to be absorbed into the main boiler (412) boiler water. The steam, after it passes through the superheater 27, is directed to the accumulators 433 via valve 487 and heats the condensate stored in the accumulators 433 at temperatures and pressures to correspond with the temperatures and pressures at the outlet header of the superheater 27. Condensate is directed as make up water to the boiler waterwall 423, via valve 486. In addition, isolation valves 488 and 486 segregate the accumulator from the boiler 412 and drum 25 under normal boiler operating conditions e.g., higher temperatures and pressures than accumulator control "starting pressure" of 1000 psig, as controlled by the control system 410.

The power generation system and control therefore provided by the described embodiments provide financial, emissions and operational benefits to operators. In particular, fuel savings and emissions reductions can be achieved by optimizing the preheating time from both warm start and cold start conditions of the boiler. The power generation system 110 provides for main boiler shut down and restart by precision control of turbine ventilation, optional compressors, and an optional auxiliary heat source and a selective boiler/steam drum reheating process. For example, significant savings may be realized for each boiler in operation by facilitating main boiler shut down and restart permitting the power generation system to be more responsive to variations in grid demand. These cost savings can be achieved as a result of the lower amount of fuel and emissions associated with efficiently operating the generator to use the turbine to facilitate system warming and restarts. The reduction also results in improved emissions as operation of the main boiler at inefficient conditions of reduced power are avoided. Furthermore, employing the turbine ventilation for reheating while the main boiler is not operating avoids the need to operate or use auxiliary power that is needed to operate the downstream equipment, including fans and pumps for the required air quality control equipment. The reduction in auxiliary power translates into the need for less fuel and steam to achieve a given production level which, in turn, further reduces the fuel requirements and increases efficiency.

In addition to operational savings, the power generation system of the described embodiments provides for capital cost savings on new plant or boiler design and construction. In particular, with the control system disclosed herein, it is possible to design/plan equipment for lower boiler restart constraints. Furthermore, the power generation system of the described embodiments provides for capital and recurring cost savings on existing retrofitted plant or boiler designs and constructions. In particular, with the system and methodology disclosed herein, it is possible to modify existing equipment for lower restart constraints while achieving faster restarts.

While the power generation system of the described embodiments allows for the real-time monitoring of numerous operational parameters that are utilized by a controller to precisely control turbine ventilation and boiler reheating, the described embodiments are not so limited in this regard. In particular, the various sensor feedbacks, in addition to being used in boiler preheating process control, can be stored and compiled for use in diagnostic and predictive analytics for asset performance and maintenance assessments of the process and equipment. That is, the data obtained from the various sensors and measurement devices can be stored or transmitted to a central controller or the like so that equipment and process performance can be assessed and analyzed. For example, the sensor feedbacks can be utilized to assess equipment health, for use in scheduling maintenance, repairs and/or replacement.

While in embodiments, the execution of sequences of instructions in a software application can cause at least one processor to perform the methods/processes described herein, hard-wired circuitry may be used in place of, or in combination with, software instructions for implementation of the described methods/processes. Therefore, embodiments as described herein are not limited to any specific combination of hardware and/or software.

As used herein, "electrical communication" or "electrically coupled" means that certain components are configured to communicate with one another through direct or indirect signaling by way of direct or indirect electrical connections. As used herein, "mechanically coupled" refers to any coupling method capable of supporting the necessary forces for transmitting torque between components. As used herein, "operatively coupled" refers to a connection, which may be direct or indirect. The connection is not necessarily being a mechanical attachment.

As used herein, an element or step recited in the singular and proceeded with the word "a" or "an" should be understood as not excluding plural of said elements or steps, unless such exclusion is explicitly stated. Furthermore, references to "one embodiment" of the described embodiments are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Additionally, while the dimensions and types of materials described herein are intended to define the parameters associated with the described embodiments, they are by no means limiting and are exemplary embodiments. Many other embodiments will be apparent to those of skill in the art upon reviewing the above description. The scope of the invention should, therefore, be determined with reference to the appended claims. Such description may include other examples that occur to one of ordinary skill in the art and such other examples are intended to be within the scope of the claims if they have structural elements that do not differ from the literal language of the claims, or if they include equivalent structural elements with insubstantial differences from the literal languages of the claim. In the appended claims, the terms "including" and "in which" are used as the plain-English equivalents of the respective terms "comprising" and "wherein." Moreover, in the following claims, terms such as "first," "second," "third," "upper," "lower," "bottom," "top," etc. are used merely as labels, and are not intended to impose numerical or positional requirements on their objects. Further, the limitations of the following claims are not written in means-plus-function format are not intended to be interpreted as such, unless and until such claim limitations expressly use the phrase "means for" followed by a statement of function void of further structure.

What is claimed is:

1. A system for preheating a steam driven power generation system, comprising:

a boiler system including:

a main boiler with a combustion system, the boiler system operative to generate steam when the combustion system is operative;

a steam drum with an input fluidly coupled to the main boiler;

a superheater having an input and an output, the input of the superheater fluidly coupled to an output of the steam drum, the superheater operable to superheat steam generated in the main boiler;

a reheater having an input and an output, the reheater operable to reheat cooled expanded steam;

a plurality of steam pipes, the plurality of steam pipes including a first steam pipe having a first end fluidly connected to the output of the superheater, a second steam pipe and a third steam pipe;

a turbine having at least a high pressure section and an intermediate pressure section, the turbine operable to receive steam and convert the steam to rotational power, wherein an input to the high pressure section is fluidly connected to a second end of the first steam pipe and operable to carry superheated steam from the superheater of the boiler system to the high pressure section of the turbine, wherein an output of the high pressure section is fluidly connected to a first end of the second steam pipe, and a second end of the second steam pipe is connected to the input of the reheater and is operable to carry the cooled expanded steam to the reheater, the output of the reheater is connected to a first end of the third steam pipe, and a second end of the third steam pipe is connected to an input of the intermediate pressure section and is operable to carry reheated steam from the reheater to the intermediate pressure section of the turbine;

an auxiliary heat source operative to provide steam;

a first flow control valve operable to control a flow of steam from the auxiliary heat source to the first steam pipe;

a second flow control valve operable to control a flow of steam from the auxiliary heat source to the third steam pipe;

a first isolation valve disposed at the first end of the first steam pipe between the first steam pipe and the superheater, the first isolation valve operable to isolate flow associated with the boiler system in the first steam pipe;

a second isolation valve disposed at the second end of the second steam pipe between the second steam pipe and the input to the reheater, the second isolation valve operable to isolate flow associated with the boiler system in the second steam pipe;

a third isolation valve disposed at the first end of the third steam pipe between the third steam pipe and the output of the reheater, the third isolation valve operable to isolate flow associated with the boiler system in the third steam pipe;

at least one electric heater operably configured to heat steam directed to the first steam pipe and the third steam pipe;

a sensor, the sensor operable to monitor at least one operating characteristic in the boiler system; and a controller configured to receive information associated with the monitored operating characteristic and control at least one of the first flow control valve, the second flow control valve, the first isolation valve, the second isolation valve, the third isolation valve, the auxiliary heat source, and the at least one electric heater to control the amount of steam supplied to the plurality of steam pipes and the turbine under selected conditions, and when the boiler system is not generating steam.

2. The system of claim 1, wherein:

the at least one operating characteristic is measured in at least one of the plurality of steam pipes, the main boiler, the steam drum, and the turbine.

3. The system of claim 1, wherein:

the at least one operating characteristic is measured in the first steam pipe, the main boiler, the steam drum, and the turbine.

4. The system of claim 3, wherein:

the at least one operating characteristic includes at least one of a temperature and a pressure.

5. The system of claim 3, wherein:

the at least one operating characteristic is a temperature measured at the first end of the first steam pipe.

6. The system of claim 1, wherein:

the amount of steam supplied to the plurality of steam pipes and the turbine is controlled to maintain selected constraints of at least one of the high pressure section and the intermediate pressure section of the turbine.

7. The system of claim 6, wherein:

the selected constraints include at least one of a temperature, a temperature gradient, and a pressure.

8. The system of claim 7, wherein:

the selected constraints include at least one of the temperature, the temperature gradient, and the pressure for at least one of a steam pipe of the plurality of steam pipes and the turbine.

9. The system of claim 1, wherein:

the auxiliary heat source includes a pressure limiting valve to provide steam at a reduced pressure to the third steam pipe and the intermediate pressure section of the turbine.

10. The system of claim 1, wherein:

the pressure of the steam supplied to the third steam pipe and the intermediate pressure section of the turbine is limited to 650 psi.

11. The system of claim 1, further including:

a third flow control valve operably connected between the auxiliary heat source and the boiler system;

at least one sparger disposed at the main boiler and/or the steam drum, the at least one sparger operable to mix steam from the auxiliary heat source with water therein, and wherein the controller is operable to control at least one of the auxiliary heat source and the third flow control valve so that steam is directed to the at least one sparger to warm the main boiler and/or the steam drum under selected operating conditions.

12. The system of claim 11, wherein:

the selected operating conditions include maintaining at least one of a temperature and a pressure in the main boiler and/or the steam drum.

13. The system of claim 12, wherein:

the temperature is 400° F.

14. The system of claim 11, wherein:

the selected operating conditions include when the main boiler is not generating steam and the main boiler is at a temperature lower than a selected temperature.

15. The system of claim 1, further comprising:

a fourth flow control valve operably connected to the boiler system; and an accumulator, the accumulator fluidly connected to the fourth flow control valve, wherein the accumulator is operable to collect condensate from the boiler system and to receive steam from the boiler system via the fourth flow control valve.

16. The system of claim 15, wherein:

the accumulator is configured to store steam at a selected temperature and pressure.

17. The system of claim 15, wherein: the accumulator is configured to store steam as the main boiler becomes inoperative.

18. A system for preheating a power generation system, comprising:

a boiler system including a main boiler with a combustion system, the boiler system operative to generate steam when the combustion system is operating, the main boiler having a waterwall and at the top of the waterwall a steam drum is located with an input fluidly coupled to the waterwall;

an auxiliary heat source operative to provide steam or hot water;

a first flow control valve operably connected to the auxiliary heat source and the main boiler and operable to control a flow of steam or hot water from the auxiliary heat source to the waterwall;

a first isolation valve disposed at the waterwall, the first isolation valve operable, when closed, to isolate circulation of water from the steam drum to the waterwall of the main boiler;

a sensor operable to monitor at least one operating characteristic in the boiler system; and a controller configured to receive information associated with the monitored operating characteristic and control at least the first flow control valve, the first isolation valve, and the auxiliary heat source to control the amount of steam or hot water supplied to the waterwall under selected conditions when the boiler system is not generating steam.

19. The system of claim 18, further comprising:

a pump to circulate the hot water through the auxiliary heat source and the waterwall of the main boiler, wherein the main boiler is a natural circulation boiler.

20. A method of preheating a power generation system, the power generation system having a boiler system including a main boiler and a combustion system, the boiler system operative to generate steam when the combustion system is operating, the main boiler having a waterwall and a steam drum located at a top region of the waterwall, the steam drum having an input fluidly coupled to the waterwall, the method comprising:

operably connecting an auxiliary heat source operative to provide steam or hot water to the boiler system;

controlling a flow of steam or hot water from the auxiliary heat source to the waterwall of the main boiler with a flow control valve operably connected between the auxiliary heat source and the main boiler;

isolating circulation of water from the steam drum to the waterwall of the main boiler with an isolation valve disposed at the waterwall of the main boiler;

monitoring at least one operating characteristic in the boiler system;

receiving information associated with the monitored operating characteristic with a controller; and controlling with the controller at least one of the flow control valve, the isolation valve, and the auxiliary heat source to control the amount of steam or hot water supplied to the waterwall of the main boiler when the boiler system is not generating steam to warm the main boiler.

* * * * *